United States Patent [19]

Ulubay et al.

[11] Patent Number: 4,632,730

[45] Date of Patent: Dec. 30, 1986

[54] METHOD FOR INCREASING THE ABSORPTION RATE OF PAPER

[75] Inventors: Hasan Ulubay, Kreuzau; Horst Schürmann, Duren, both of Fed. Rep. of Germany

[73] Assignee: Akzo NV, Arnhem, Netherlands

[21] Appl. No.: 727,737

[22] Filed: Apr. 29, 1985

[30] Foreign Application Priority Data

Apr. 30, 1984 [DE] Fed. Rep. of Germany ..... 3416043

[51] Int. Cl.[4] ..... D21H 3/08; D21H 5/24

[52] U.S. Cl. ..... 162/111; 162/112; 162/135; 162/158; 162/164.3; 162/179

[58] Field of Search ..... 162/158, 179, 183, 111, 162/100, 112, 164.3, 135; 427/395; 428/153; 264/282, 283

[56] References Cited

U.S. PATENT DOCUMENTS

| | | | |
|---|---|---|---|
| 3,180,786 | 4/1965 | Domba et al. | 162/158 |
| 3,637,869 | 1/1972 | Seizinger | 162/158 |
| 4,303,471 | 12/1981 | Laursen . | |
| 4,483,741 | 11/1984 | Maloney et al. | 162/5 |

FOREIGN PATENT DOCUMENTS

| | | |
|---|---|---|
| 878981 | 8/1971 | Canada . |
| 1955454 | 5/1970 | Fed. Rep. of Germany . |
| 2140010 | 8/1971 | Fed. Rep. of Germany . |
| 2161772 | 12/1971 | Fed. Rep. of Germany . |
| 2929512 | 1/1980 | Fed. Rep. of Germany . |
| 3322330 | 2/1984 | Fed. Rep. of Germany . |
| 3404086 | 8/1984 | Fed. Rep. of Germany . |
| 402607 | 7/1978 | Sweden . |
| 1382467 | 8/1972 | United Kingdom . |

OTHER PUBLICATIONS

Technicshes Markblatt Afranil TH Flüssig.

*Chemical Abstracts*, vol. 89, No. 181,429c, entitled "Absorbent Cellulose Material", by Laursen, B. L.

*Primary Examiner*—Peter Chin

*Attorney, Agent, or Firm*—Parkhurst & Oliff

[57] ABSTRACT

Paper, especially wet- or dry-creped paper, is manufactured with a high rate of absorption of aqueous media by using carboxylic acid esters of carboxylic acids with 8 to 30 carbon atoms and at least one of ethoxylated and/or propoxylated primary and/or secondary alcohols with 12 to 40 C atoms, ethoxylated and/or propoxylated alkyl phenols, ethoxylated and/or propoxylated amines, and ethoxylated and/or propoxylated amides, with a degree of ethoxylation or propoxylation of 3 to 50; and/or by using polyethers obtained from the reaction of long-chain epoxides with 8 to 30 carbon atoms and at least one of ethoxylated and/or propoxylated primary and/or secondary alcohols with 12 to 40 C atoms, ethoxylated and/or propoxylated alkyl phenols, ethoxylated and/or propoxylated amines, and ethoxylated and/or propoxylated amides, with a degree of ethoxylation or propoxylation of 3 to 50.

17 Claims, No Drawings

METHOD FOR INCREASING THE ABSORPTION RATE OF PAPER

The invention relates to the manufacture of paper, especially wet- or dry-creped paper with a high rate of absorption of aqueous media. A high water absorption rate is especially required for paper which is used in the area of hygiene, for example, toilet paper, paper towels, kitchen paper towels, etc.

BACKGROUND OF THE INVENTION

To meet the requirements of softness and absorbency, high-quality pulp is still used today for the most part with the absorbency of a pulp determined by fiber length and diameter and freeness. Fibers with a low freeness, as well as large fiber diameters, generally produce bulkier and therefore more absorbent paper. Pulp obtained from conifers, e.g., Scotch pine or Douglas fir, followed by spruce, is useful for soft, highly absorbent products. Deciduous trees, with the exception of the beech, generally produce a low absorbency.

Because of the scarcity and increase in cost of raw materials, greater efforts are made today to use waste paper and lower grade pulp. These raw materials, however, because of their high freeness, produce compact paper web with a low absorbency. Moreover, drainage on papermaking machines also deteriorates because of the high freeness, which also reduces the speed of the papermaking machines.

Types of tissues, such as, for example, tissues and kitchen paper towels, may have more or less wet strength. Cationic wet strength agents, such as, for example, polyamideamine-epichlorohydrin condensation products, are used to increase wet strength.

The creping of the paper is executed, for example, so that the paper web can be guided onto a can dryer with a large diameter and dried there and removed from the cylinder surface by means of a so-called crepe ductor at the end of the process in the cylinder. The extent of the creping is determined by the difference in the speed between the can dryer and the subsequent rolling up.

With use of high-quality fibers, it was necessary in part to improve the required adhesion between the paper web and the can dryer by so-called creping aids (adhesive agents). Increased use of waste paper with a high freeness, as well as a high proportion of filler and screened stock, as raw material for tissues generally leads to a deterioration in drainage in the wire part, greater adhesion to the can dryer, and considerable abrasion of the crepe ductor. The chemicals used to increase wet strength further reduce drainage and the absorbency of the paper and increase the adhesive effect on the can dryer.

Absorbent cellulose products, which are produced by dry defibration from cellulose pulp or cellulose fibrous pulp with floc formation, are used in sanitary products such as diapers and sanitary towels or napkins. In this case, the cellulose pulp should possess a low mechanical strength to facilitate the separation of fibers without their degradation and to reduce the energy required for the separation. Flocs obtained after the dry separation should possess a good fluid absorption capacity and a short absorption time.

The use of cationic surface-active agents such as quaternary ammonium compounds to reduce adhesion of cellulose fibers is known. These compounds have a considerable adverse effect on water absorption time.

Additional disadvantages of the quaternary ammonium compounds are corrosion damage to equipment and frequently the reduction of the lightness of flocs, because the compounds typically have a chloride ion as the anion.

The reduction of adhesiveness by addition of nonionic substances to cellulose pulp is also known. According to German Offenlegungsschrift No. 19 55 454, nonionic substances, which are ethoxylated or propoxylated aliphatic alcohols or alkyl phenols, are used. Swedish Pat. No. 402,607, cited in Chemicals Abstracts Vol. 89, No. 181,429, shows a process in which alkoxylated aliphatic alcohols are used as retention agents in combination with quaternary ammonium salts.

An additional process is known from German Offenlegungsschrift No. 29 29 512, in which nonionic compounds are used in the preparation of absorbent cellulose pulp; in this case, these compounds consist of partial fatty acid esters of polyols with 2 to 8 carbon atoms or their anhydrides, i.e., anhydrous derivatives such as, for example, internal ethers, or consist of polyethylene or polypropylene glycols with molecular weights up to 500.

SUMMARY OF THE INVENTION

The object of the present invention was to improve the known processes for the preparation of absorbent paper, especially dry- or wet-creped paper, to such a degree that the adhesion to the can dryer is reduced and deposit formation on the can dryer is prevented.

This object is achieved by using carboxylic acid esters of carboxylic acids with 8 to 30 carbon atoms and at least one of ethoxylated and/or propoxylated primary and/or secondary alcohols with 12 to 40 carbon atoms, ethoxylated and/or propoxylated alkyl phenols, ethoxylated and/or propoxylated amines, and ethoxylated and/or propoxylated amides, with a degree of ethoxylation or propoxylation of 3 to 50.

This object is also achieved by using polyethers obtained from the reaction of long-chain epoxides with 8 to 30 carbon atoms with at least one of ethoxylated and/or propoxylated primary and/or secondary alcohols with 12 to 40 carbon atoms, ethoxylated and/or propoxylated alkyl phenols, ethoxylated and/or propoxylated amines and ethoxylated and/or propoxylated amides, with a degree of ethoxylation or propoxylation of 3 to 50.

DETAILED DESCRIPTION OF PREFERRED EMBODIMENTS OF THE INVENTION

In a preferred embodiment of the invention, the alkyl group or the ethoxylated and/or propoxylated alkyl phenol carboxylic acid esters and/or polyesters contain 8 to 16 carbon atoms, for example, an ethoxylated and/or propoxylated nonyl phenol. Especially suitable alcohols are ethylhexanol, dodecanol, lauryl alcohol, stearyl alcohol, and the so-called Guerbet alcohols.

These Guerbert alcohols can be described by the structural formula

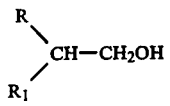

in which R corresponds to an alkyl group with the general formula $C_nH_{2n+1}$, and $R_1$ corresponds to an alkyl group with the general formula $C_{n-2}H_{2n-3}$. Preferably, n=8−19 in this case.

Suitable as ethoxylated and/or propoxylated amines are also, for example, polyoxyethylene coco amines, polyoxyethylene tallow amines, polyoxyethylene oleylamines, and polyoxyethylene octadecylamines, which are commercially available with different degrees of ethoxylation under the trade name Ethomeen®. Ethoxylated amines are commercially available under the trade name Ethomid® and include, for example, polyoxyethylene oleoamides and polyoxyethylene tallow amides. These are also suitable initial products for the carboxylic acid esters and/or polyethers used according to the invention.

Fatty and oleoresin acids are especially suitable as carboxylic acids. Carboxylic acids which have 12 to 20 carbon atoms, for example, oleic acid, palmitic acid or abietic acid, are preferable.

Preferred long-chain epoxides suitable for the invention include 1,2-epoxides with 8 to 30 carbon atoms, such as 1,2-epoxyoctane, 1,2-epoxynonane, 1,2-epoxydecane, 1,2-epoxyundecane, 1,2-epoxydodecane, 1,2-epoxytridecane, 1,2-epoxytetradecane, 1,2-epoxypentadecane, 1,2-epoxyhexadecane, 1,2-epoxyheptadecane, 1,2-epoxyoctadecane, 1,2-epoxynonadecane, 1,2-epoxyeicosane, 1,2-epoxyuneicosane, 1,2-epoxydocosane, 1,2-epoxytricosane, 1,2-epoxytetracosane, 1,2-epoxypentacosane, 1,2-epoxyhexacosane, 1,2-epoxyheptacosane, 1,2-epoxyoctacosane, 1,2-epoxynonacosane, and 1,2-epoxytriacontane.

Preferably polyethers in which the long-chain 1,2-epoxide has 12 to 18 carbon atoms are used.

The preferred degree of ethoxylation and/or propoxylation of ethoxylated and/or propoxylated primary or secondary alcohols, alkyl phenols, amines and/or amides converted to carboxylic acid esters or polyethers is 5 to 15.

Carboxylic acid esters are prepared by reacting the ethoxylated and/or propoxylated alcohols, alkyl phenols, amines and/or amides with the corresponding carboxylic acids at temperatures between approximately 160°–225° C. and under normal pressure, with the addition of 0.1 to 0.5 wt.% of p-toluenesulfonic acid, in relation to total quantity, as the catalyst. After the bulk of the reaction water is stripped off, the remaining reaction water is drawn off at a vacuum of 80 to 100 mbar. The acid value of the final product is approximately 5–8.

The polyethers are prepared by reacting the ethoxylated and/or propoxylated alcohols, alkyl phenols, amines and/or amides with the corresponding long-chain, 1,2-epoxides, using 0.1 to 0.5 wt.% KOH, in relation to total quantity, as the catalyst at temperatures between 100°–180° C.

The following improvements are achieved by the novel use of carboxylic acid esters and/or polyethers in accordance with the present invention:

acceleration of drainage,
anti-foaming action on the pulp water,
reduction of adhesion to the can dryer,
prevention of deposit formation on the can dryer,
increase in service life of crepe ductor,
increase in the absorption rate of the prepared paper upon rewetting, often by a factor of 2 or more.

The carboxylic acid esters and/or polyethers used according to the invention also exhibit excellent self-emulsifying properties, making preliminary dilution unnecessary. For this reason, a preferred form of execution of the present invention is one in which the carboxylic acid esters and/or polyethers are added as liquids in a compound concentration of more than 80 wt.%.

For polyethers that are solid, the addition is preferably carried out as an aqueous dispersion or solution for a better dosage of the polyether.

The carboxylic acid esters and/or polyethers are preferably added to the paper in an amount of 0.05 to 0.5 wt.%, in relation to absolutely dry pulp.

In practising the invention, the carboxylic acid esters and/or polyethers are preferably added to the hollander, pulper and/or during sheet formation. However, they can also be added ahead of the grinding elements, in the mixing chest or shortly before the stock flow onto the paper machine wire.

The following measuring methods were used to determine the surface weight of the paper, water absorption time, breaking length (dry) and breaking length (wet) in the following examples:

| | |
|---|---|
| 1. basic weight of the paper | DIN 53104 |
| 2. absorption time for a droplet size of 0.05 ml | TAPPI T432 ts64 (corresponds to ASTM D824-67 (1971)) |
| 3. breaking length (wet) | DIN 53112 |
| 4. breaking length (dry) | DIN 53112 |

A Kammerer laboratory test machine was used in the examples, and the chemicals were added continuously to the mixture in the indicated amounts. In all examples, 4% of a commercially available wetting agent based on a polyamideamineepichlorohydrin condensation product (Etadurin N76, 12.5%) was added as the wet strength agent. Commercial products used to increase absorption rate, which represented a mixture of high-molecular-weight cationic condensates and a nonionogenic dispersing agent, served as comparison products 1 and 2. Comparison product 3 was an alkylphenol polyglycol ether.

EXAMPLE 1

A waste paper mixture of 50% newspaper and 50% corrugated board with a freeness of 53° SR was used as the raw material for processing into paper with a basic weight of 50 g/m² at a temperature of 30° C. The pH of the stock flow onto the paper machine wire was 7.5. In this case, according to the invention, carboxylic acid esters were used; specifically, A was an ester of nonylphenolethoxylate with a degree of ethoxylation of 8 and abietic acid, and B was an ester of oleylethoxylate with a degree of ethoxylation of 8 and abietic acid.

The data obtained here, the comparison data without addition of agents to increase absorption rate, and the data obtained with commercially available agents 1 and 2 are presented below in Table I.

TABLE I

| | Agent | | | | |
|---|---|---|---|---|---|
| | None | 1 | 2 | A | B |
| Amount used (%) | — | 0.1 | 0.1 | 0.1 | 0.1 |
| Breaking length dry (m) | 5098 | 5067 | 5170 | 4760 | 4900 |
| Breaking length wet (m) | 1412 | 1267 | 1374 | 1306 | 1367 |
| Absorption time (sec) | 308 | 103 | 98 | 83 | 87 |

EXAMPLE 2

A mixture of pine sulfate pulp and waste paper was used as the raw material, specifically:

50% pine sulfate pulp
25% newspaper
25% magazines
Freeness 54° SR
Temperature 30° C.

The pH during stock flow onto the wire was 8.2.

A carboxylic acid ester (C) of nonylphenolethoxylate with a degree of ethoxylation of 9 and stearic acid served as the agent for increasing absorbency according to the invention.

The findings and comparison results are summarized in Table II. The basic weight of the paper was 34 g/m$^2$.

TABLE II

| | Agent | | | | |
|---|---|---|---|---|---|
| | None | C | C | 3 | 3 |
| Amount used (%) | — | 0.1 | 0.3 | 0.1 | 0.3 |
| Breaking length dry (m) | 5050 | 5137 | 4985 | 5175 | 5642 |
| Breaking length wet (m) | 1133 | 1257 | 1154 | 1294 | 1178 |
| Absorption time (sec) | 244 | 108 | 69 | 104 | 108 |

EXAMPLE 3

The raw material was a pulp mixture of

50% pine sulfate pulp
25% birch sulfate pulp
25% beech pulp
Freeness 24° SR
Stock temperature 20° C.

The pH during stock flow onto the wire was 7.5.

0.1 wt.% carboxymethylcellulose was used as an additional agent. The basic weight of paper was 72 g/m$^2$. The same products as in example 2 were used here as the carboxylic acid ester according to the invention. Findings are shown in Table III.

TABLE III

| | Agent | | | |
|---|---|---|---|---|
| | None | C | C | C |
| Amount used (%) | — | 0.1 | 0.2 | 0.3 |
| Absorption time (sec) | 39 | 38 | 16 | 14 |

EXAMPLE 4

Raw material:

50% pine sulfate pulp
25% birch sulfate pulp
25% beech sulfate pulp.

Freeness: 24° SR.
Stock temperature: 20° C.
Additional agent: 0.1% carboxymethylcellulose.
pH during stock flow onto the wire: 7.5.
Surface weight of paper: about 50 g/m$^2$.

Products C, D, E, and F were added to increase absorption rate.

Product C: is identical to products C in examples 2 and 3.

Product D: ester of nonylphenolethoxylate with a degree of ethoxylation of 9 and hardened stearic acid.

Product E: ester of nonylphenolethoxylate with a degree of ethoxylation of 12 and hardened stearic acid.

Product F: polyether of nonylphenolethoxylate with a degree of ethoxylation of 9 and C18-epoxide.

Findings are summarized in Table IV.

TABLE IV

| | Agent | | | | |
|---|---|---|---|---|---|
| | None | C | D | E | F |
| Amount used (%) | — | 0.2 | 0.2 | 0.2 | 0.2 |
| Absorption time (sec) | 86 | 40 | 35 | 49 | 39 |

EXAMPLE 5

Raw material:

70% spruce sulfate pulp
30% beech sulfate pulp.

Freeness: 39° SR.
Stock temperature: 20° C.
Additional agent: $Na_2CO_3$.
pH during stock flow onto the wire: 7.9.
Basic weight of paper: about 50 g/m$^2$.

Product C in examples 2, 3 and 4 was compared with a commercial product, which is identical to the comparison agent 2 used in example 1. Table V shows the findings.

TABLE V

| | Agent | | |
|---|---|---|---|
| | None | C | 2 |
| Amount used (%) | — | 0.2 | 0.2 |
| Breaking length dry (m) | 6131 | 5577 | 5444 |
| Breaking length wet (m) | 1210 | 1414 | 1407 |
| Absorption time (sec) | 330 | 75 | 242 |

What is claimed is:

1. A method for increasing the absorption rate of aqueous media of paper, comprising adding carboxylic acid esters of carboxylic acids with 8 to 30 carbon atoms and at least one member selected from the group consisting of ethoxylated and/or propoxylated primary and/or secondary alcohols with 12 to 40 carbon atoms, ethoxylated and/or propoxylated alkyl phenols, ethoxylated and/or propoxylated amines, and ethoxylated and/or propoxylated amides, with a degree of ethoxylation or propoxylation of 5 to 50, during the manufacture of said paper.

2. A method for increasing the absorption rate of aqueous media of paper, comprising adding polyethers, obtained from the reaction of long chain epoxides with 8 to 30 carbon atoms with at least one member selected from the group consisting of ethoxylated and/or propoxylated primary and/or secondary alcohols with 12 to 40 carbon atoms, ethoxylated and/or propoxylated alkyl phenols, ethoxylated and/or propoxylated amines, and ethoxylated and/or propoxylated amides, with a degree of ethoxylation or propoxylation of 3 to 50, during the manufacture of said paper.

3. Method according to claim 1, wherein said paper is selected from the group consisting of dry-creped paper and wet-creped paper.

4. Method according to claim 2, wherein said paper is selected from the group consisting of dry-creped paper and wet-creped paper.

5. Method according to claim 1, wherein the alkyl group of the ethoxylated and/or propoxylated alkyl phenol contains 8 to 16 carbon atoms.

6. Method according to claim 2, wherein the alkyl group of the ethoxylated and/or propoxylated alkyl phenol contains 8 to 16 carbon atoms.

7. Method according to claim 1, wherein the carboxylic acid contains 12 to 20 carbon atoms.

8. Method according to claim 2, wherein the long-chain 1,2-epoxide contains 12 to 18 carbon atoms.

9. Method according to claim 1, wherein the carboxylic acid ester is added to the paper in an amount of 0.05 to 0.5 wt.% in relation to absolutely dry pulp.

10. Method according to claim 2, wherein the polyether is added to the paper in an amount of 0.05 to 0.5 wt.% in relation to absolutely dry pulp.

11. Method according to claim 1, wherein the carboxylic acid ester is added to the hollander, pulper and/or during sheet formation.

12. Method according to claim 2, wherein the polyether is added to the hollander, pulper and/or during sheet formation.

13. Method according to claim 1, wherein the carboxylic acid ester is added as a liquid in a compound concentration of more than 80 wt.%.

14. Method according to claim 2, wherein the polyether is added as a liquid in a compound concentration of more than 80 wt.%.

15. Method according to claim 2, wherein the polyether is added as an aqueous dispersion or solution.

16. Method according to claim 1, wherein the degree of ethoxylation or propoxylation is 5 to 15.

17. Method according to claim 2, wherein the degree of ethoxylation or propoxylation is 5 to 15.

* * * * *